United States Patent [19]

Maekawa et al.

[11] Patent Number: 4,506,315

[45] Date of Patent: Mar. 19, 1985

[54] VEHICLE HEADLAMP

[75] Inventors: Masashi Maekawa, Atsugi; Tatsumi Hasegawa, Hatano, both of Japan

[73] Assignee: Ichikoh Industries, Ltd., Tokyo, Japan

[21] Appl. No.: 447,885

[22] Filed: Dec. 8, 1982

[51] Int. Cl.[3] ..... F21V 7/00

[52] U.S. Cl. ..... 362/308; 362/297; 362/61; 362/80; 362/83; 362/346

[58] Field of Search ..... 362/267, 299, 308, 309, 362/61, 80, 83, 346, 297; 313/479, 239, 240

[56] References Cited

U.S. PATENT DOCUMENTS

| | | | |
|---|---|---|---|
| 1,413,315 | 4/1922 | Correll . | |
| 1,737,027 | 11/1929 | Schoonmaker . | |
| 4,210,841 | 7/1980 | Vodicka | 362/267 |
| 4,351,018 | 9/1982 | Fratty . | |

FOREIGN PATENT DOCUMENTS

| | | |
|---|---|---|
| 1322377 | 7/1973 | United Kingdom . |
| 2011600 | 7/1979 | United Kingdom . |
| 2079434 | 1/1982 | United Kingdom . |

OTHER PUBLICATIONS

European Search Report

*Primary Examiner*—Donald P. Walsh

*Attorney, Agent, or Firm*—Schwartz, Jeffery, Schwaab, Mack, Blumenthal & Koch

[57] ABSTRACT

A vehicle headlamp comprises a reflector having a reflecting parabolic face, and a lens made of synthetic resin and attached to the front end of said reflector. The vehicle headlamp further includes a lamp held by said reflector, at least one filament in said lamp positioned ahead the focussing point of said reflector, and a zone formed on the reflecting face where a means is arranged to reduce the amount of light coming from the filament onto the lens at an upper area thereof, said zone being positioned above the lamp and along an axis vertically passing through an optical axis. Said light reducing means is intended to reflect light either irregularly or diffusedly. The irregularly reflecting means comprises using no undercoat which serves to make the reflecting coat flat and smooth, or making the reflector body rough and uneven and then applying reflecting coat onto this rough and uneven portion with the undercoat interposed therebetween. The diffusedly reflecting means comprises forming slanted faces on the inner face of said reflector body and applying the reflecting coat onto these slanted faces with the undercoat interposed therebetween.

7 Claims, 5 Drawing Figures

VEHICLE HEADLAMP

BACKGROUND OF THE INVENTION

The present invention relates to a vehicle headlamp and, more particularly, a vehicle headlamp having a front lens particularly made of synthetic resin.

The conventional front lens used in vehicle headlamps is made by press-molding a mass of molten glass. A front lens made of synthetic resin has been developed because it can be light-weight and because a plurality of prisms can be easily formed thereon to disperse the light from a filament.

However, where a front lens of synthetic resin is employed, and the lamp filaments are positioned between the focal point of the reflector and the lens; conditions of high temperature or high terminal voltage will cause enough infrared radiation to impinge on the upper part of the lens to soften the lens. This will be described in more detail referring to the conventional headlamp shown in FIGS. 1 and 2. FIG. 1 is a front view showing the conventional headlamp and FIG. 2 is a sectional view taken along the line I—I in FIG. 1.

As shown in FIG. 2, a synthetic resin lens 1 is attached to the front end of a reflector 2. The reflector 2 has a reflecting surface 3 which is made substantially parabolic; to the reflecting surface 3 is fixed a lamp holder 4 for attaching a lamp 6 to the reflector 2. The lamp 6 attached to the lamp holder 4 by means of a set spring 5 includes a main filament 8, a sub-filament 9 and a light shielding cap 10 in a glass envelope 7. Said light shielding cap 10 serves to cover about the lower half of said sub-filament 9. The main filament 8 is nearly positioned at the focal point (f) of said reflector 2, while the sub-filament 9 is positioned ahead the focal point (f). Numeral 11 represents a light shielding coating applied to the front end of the glass envelope 7.

Light radiated from the main filament 8 is reflected by the reflecting surface 3 substantially parallel to an optical axis (X) or diffused. On the contary, light (L) radiated from the sub-filament 9 is reflected by the reflecting surface 3 to be focussed. This is because the sub-filament 9 is positioned ahead the focal point (f).

Vehicles are used under various conditions (on hot deserts, for example). The headlamp of a vehicle which runs on this desert area is under high temperature atmosphere. It is therefore necessary to test the headlamp to see if the headlamp can be used at high temperatures (80° C., for example). When the headlamp exposed as described above is left turned on at air temperatures of 80° C., air inside the headlamp becomes hot due to the hot air surrounding the, and due to headlamp, heat focussed by operation of the lamp 6 itself while on, particularly at the upper portion thereof. As a result, heat is concentrated onto an area (A) at the upper portion of the lens 1 as shown in FIG. 1, so that the lens 1 is softened there.

This softening is caused even under normal temperatures when terminal voltage becomes high. When terminal voltage becomes high, light radiated from the sub-filament 9 becomes intense, and much heat is radiated. Therefore, reflected light (L) and radiated heat combines with the hot air inside the headlamp to soften the area (A).

SUMMARY OF THE INVENTION

An object of the present invention is to reduce the amount of reflected light incident the upper area of a synthetic resin lens and to prevent heat from being concentrated onto said area.

Another object of the present invention is to provide a simple construction for preventing heat from being concentrated onto the upper area of said synthetic resin lens.

These and other objects as well as features of the present invention will become apparent from the following detailed description with accompanying drawings.

BRIEF DESCRIPTION OF THE DRAWINGS

FIG. 1 is a front view thereof and FIG. 2 is a sectional view taken along the line I—I in FIG. 1.

DETAILED DESCRIPTION OF THE PREFERRED EMBODIMENTS

Figure 1:
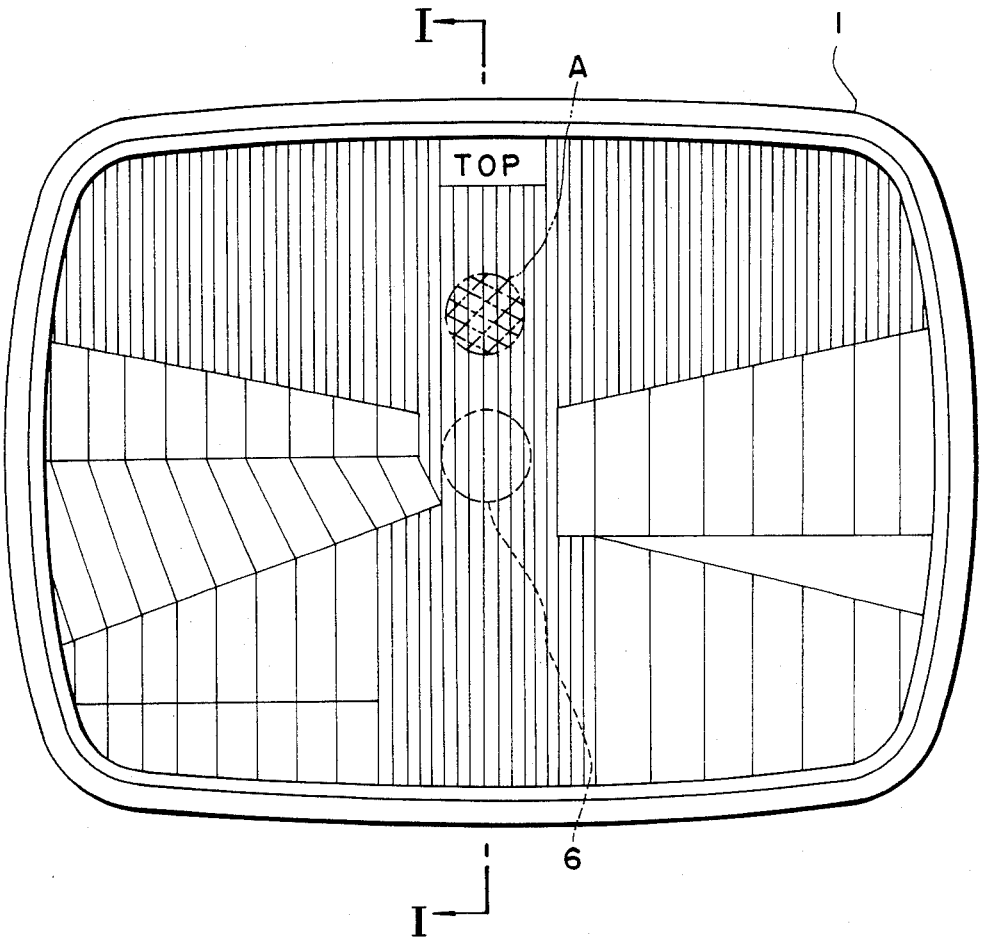
FIGS. 1 and 2 show the conventional vehicle headlamp.
Figure 2:
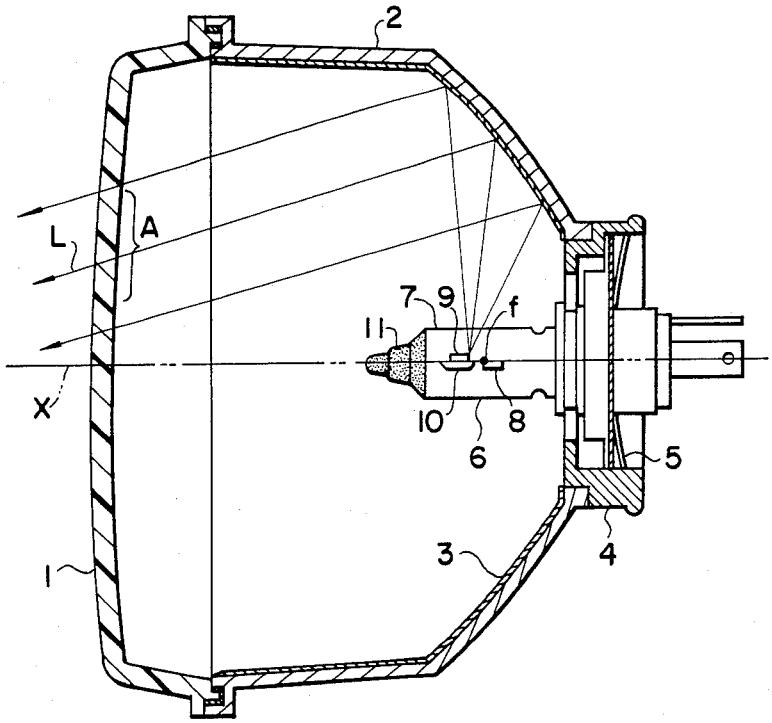
Figure 3:
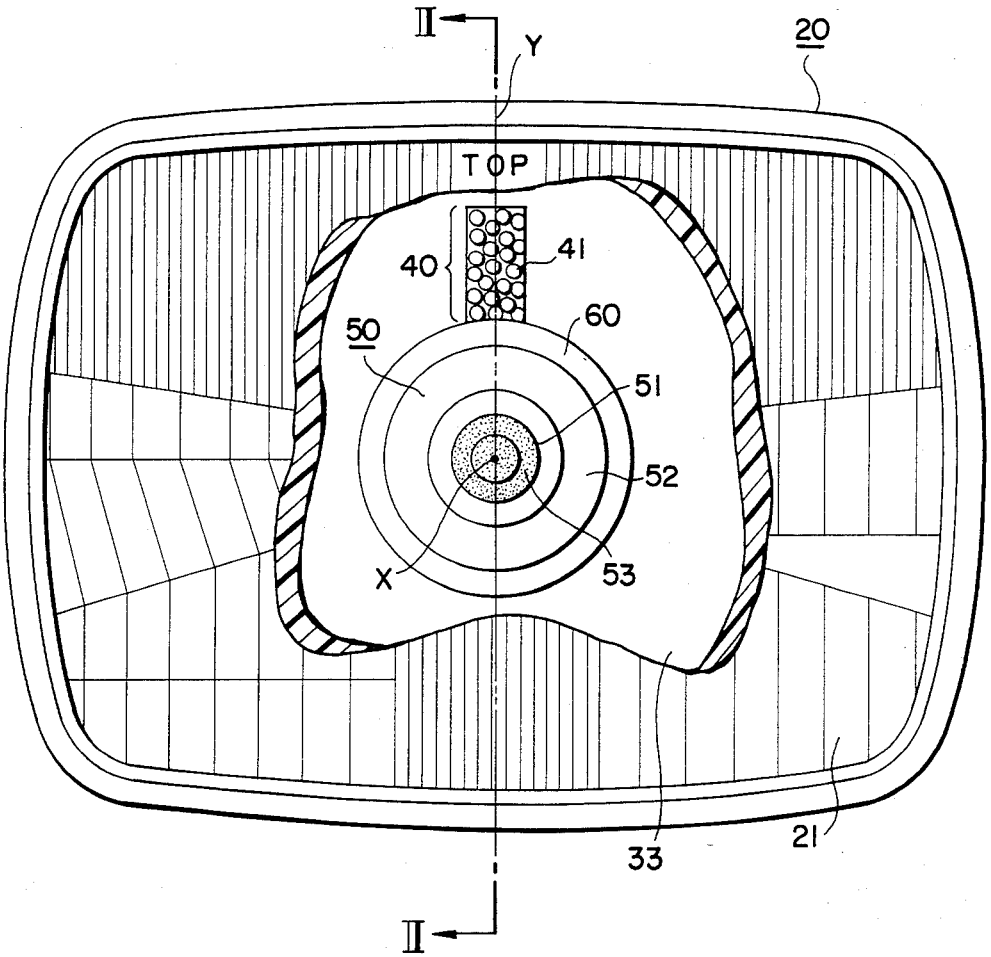
FIG. 3 is a front view, partly cut away, showing an embodiment of the present invention.
Figure 4:
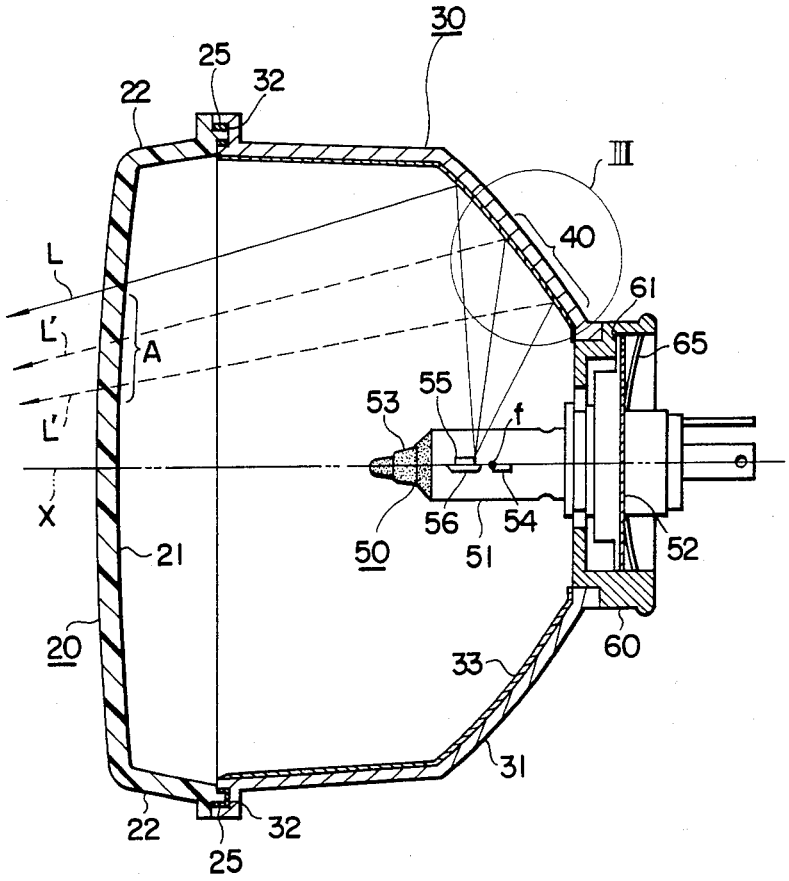
FIG. 4 is a cross sectional view taken along the line II—II in FIG. 3.

As shown in FIG. 3, a vehicle headlamp according to the present invention is of rectangular shape and includes a lens 20 attached to the front end of a reflector 30, as shown in FIG. 4. The lens 20 is made of transparent synthetic resin such as polycarbonate, for example, and comprises a lens face 21 formed on the inner surface thereof and having a plurality of prisms to control light, and a side wall 22 enclosing the lens face 21. The side wall 22 is air-tightly attached to the opened end face of the reflector 30 by means of a bonding agent 25 which is previously filled in a groove 32 formed on the opened front end face of said reflector 30.

The reflector 30 has about a substantially parabolic reflecting surface 33 inside. The reflecting surface 33 has an attachment hole, in which is fixed a lamp holder 60 for attaching a lamp 50 thereto. The reflector 30 may be formed integrally with the lamp holder 60.

The lamp holder 60 is cylindrical so as to enable a glass envelope 51 for the lamp 50 to be inserted through it. The lamp holder 60 has a stepped portion 61 inside, on which a flange 52 of the lamp 50 rests. The lamp 50 is attached to the lamp holder 60 in such a way that the flange 52 is held against the stepped portion 61 by means of a set spring 65.

The lamp 50 includes a main filament 54, a subfilament 55, and a light shielding cap 56 inside the glass envelope 51, to the front end of which is applied a light shielding coating 53. Said light shielding cap 56 covers substantially the lower half of the sub-filament 55. The subfilament 55 is positioned ahead of the main filament 54 in the glass envelope 51. A Halogen $H_4$ lamp according to ECE regulation may be employed as the lamp 50. The lamp 50 is attached to the lamp holder 60 in such a way that the sub-filament 55 is positioned ahead of the focal point (f) of the reflector 30. The main filament 54 is positioned substantially at the focal point (f). Therefore, light radiated from the main filament 54 is reflected by the reflecting parabolic face 33 substantially parallel to an optical axis (X) or diffused. On the contrary, light (L) radiated from the sub-filament 55 is reflected by the reflecting face 33 to become focussed, as shown in FIG. 4. In the case of this embodiment, the sub-filament 55 is positioned ahead of the focal point (f)

but with its central axis located on the optical axis (X), while the main filament 54 is positioned on the optical axis (X) at the focal point (f) but with its central axis located below the optical axis (X). The main filament 54 is used as an upper beam and the sub-filament 55 is used as a dipped beam.

Figure 5:
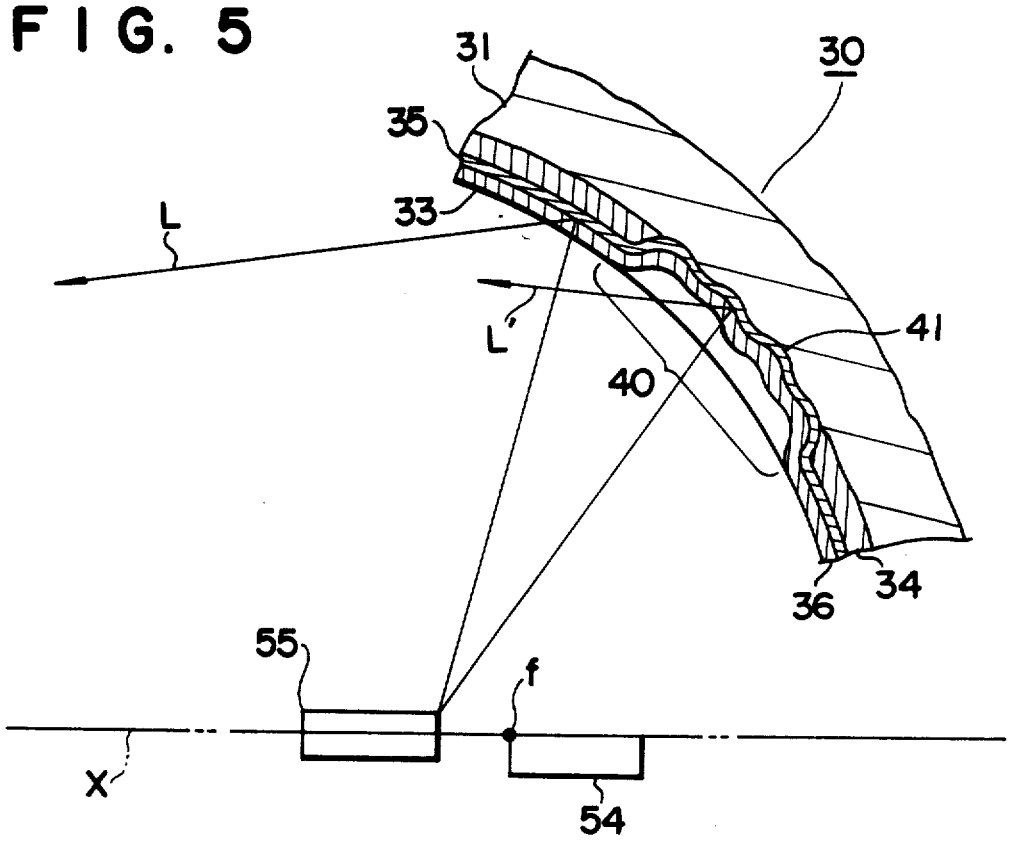
FIG. 5 is an enlarged view showing the portion III in FIG. 4.

FIG. 5 is an enlarged view showing a portion III in FIG. 4. The reflecting parabolic face 33 comprises an undercoat 34 applied to the inner face of a parabolic reflector body 31, vacuum-vaporing a reflecting coat 35 such as aluminium, for example, to the undercoat 34, and applying a transparent top coat 36 to the reflecting film 35, said transparent top coat 36 serving to protect the reflecting coat 35. The undercoat 34 is about 10–15$\mu$ thick and the reflecting coat 35 about 0.05$\mu$ thick in this embodiment. The reflector body 31 may be made of metal or of synthetic resin such as polybuthylene terephthalate, for example.

At the reflecting parabolic face 33 according to the embodiment a zone 40 is formed where a light reducing means is provided to reduce the amount of light coming from the sub-filament 55 onto the upper area (A) of the lens face 21. The position of said zone 40 is above the lamp 50 and along an axis (Y) vertically passing through the optical axis (X). The light reducing means arranged at the zone 40 is intended to irregularly reflect light, as shown in FIG. 5. This irregularly reflecting means comprises making the zone 40 undercoatless 41. When the reflector body 31 is made of metal or synthetic resin, its surface is made or molded slightly roughly and uneven. This slightly rough and uneven surface of said reflector body 31 is covered by the undercoat 34 to give no influence to the reflecting coat 35. Light (L) reflected by the reflecting parabolic face 33 is thus reflected in the predetermined direction. When the zone 40 is made undercoatless 41, however, the rough surface of said reflector body 31 is covered by the reflecting coat 35 to thereby reflect light irregularly. Light (L') reflected by the undercoatless zone 40 is thus reduced in absolute magnitude when incident onto the area (A). Even when additionally combined with atmosphere inside the headlamp, therefore, the area (A) can be kept lower in temperature and prevented from becoming softened.

Although a preferred embodiment has been described in detail referring to the accompanying drawings, it should be understood that the present invention is not limited to this embodiment but that all modifications and variations not departing from the technical scope of the present invention are included in the present invention.

We claim:

1. A vehicle headlamp comprising:

a reflector body having an open end and defining a substantially parabolic surface having a focal point;

a lens made of synthetic resin and attached to said open end of said reflector body and, a lamp comprising at least one filament in a glass envelope, said lamp being attached to said reflector body such that said filament is positioned ahead of said focal point;

said parabolic surface comprising a smooth reflecting surface for reflecting light from said lamp through said lens and an uneven light reducing zone positioned to reduce the amount of light reflected from said lamp to an upper area of said lens;

said smooth reflecting surface comprising a smooth undercoat applied over a desired portion of said parabolic surface of said reflector body and a reflecting coating applied over said undercoat, and said uneven light reducing zone comprising said reflecting coating applied directly onto said reflector body.

2. A vehicle headlamp according to claim 1 wherein said undercoat is about 10–15$\mu$ thick.

3. A vehicle headlamp according to claim 1 wherein said reflecting coat is about 0.05$\mu$ thick.

4. A vehicle headlamp according to claim 1 wherein said reflector body is made of a material selected from the group consisting of metal and synthetic resin.

5. A vehicle headlamp according to claim 1 wherein said zone is positioned above the lamp and along an axis vertically passing through an optical axis.

6. A vehicle headlamp according to claim 1 wherein the light reducing means arranged at the zone reflects light irregularly.

7. A vehicle headlamp according to claim 1 wherein said light reducing means arranged at the zone reflects light diffusedly.

* * * * *

UNITED STATES PATENT OFFICE

CERTIFICATE OF CORRECTION

PATENT NO. : 4,506,315

DATED : March 19, 1985

INVENTOR(S) : Masashi MAEKAWA and Tatsumi HASEGAWA

It is certified that error appears in the above-identified patent and that said Letters Patent are hereby corrected as shown below:

IN THE DRAWINGS:

Please add Figure 5.

Signed and Sealed this

*Eighth* Day of *October 1985*

[SEAL]

*Attest:*

DONALD J. QUIGG

*Attesting Officer*

*Commissioner of Patents and Trademarks—Designate*